United States Patent [19]

Oh

[11] Patent Number: 5,072,998

[45] Date of Patent: Dec. 17, 1991

[54] STUFFED ANATOMICAL MEMBERS

[75] Inventor: Bobby Y. Oh, Hacienda Heights, Calif.

[73] Assignee: Del Cerro Investment Group, Inc., Diamond Bar, Calif.

[21] Appl. No.: 391,094

[22] Filed: Aug. 8, 1989

[51] Int. Cl.[5] ..... A47B 97/00

[52] U.S. Cl. ..... 312/204; 248/205.2; 312/7.2; 428/16; 428/100; 446/268

[58] Field of Search ..... 428/16, 100; 40/908; 446/901, 391; D21/38; 312/204, 7.1, 7.2; 248/205.2; 273/DIG. 30

[56] References Cited

U.S. PATENT DOCUMENTS

| | | | |
|---|---|---|---|
| D. 166,503 | 4/1952 | Skelly et al. | D21/38 |
| D. 171,623 | 3/1954 | Skelly et al. | D21/38 |
| 2,819,823 | 1/1958 | Morganstern | 312/204 X |
| 3,446,546 | 5/1969 | D'Adamo | 312/204 X |
| 3,789,547 | 2/1974 | Chemarin | 428/16 X |
| 3,867,971 | 2/1975 | Hazan | 446/74 X |
| 4,015,327 | 4/1977 | McCarthy | 446/391 X |
| 4,136,484 | 1/1979 | Abrams | 446/370 |
| 4,208,832 | 6/1980 | Corriveau | 428/100 X |
| 4,532,162 | 7/1985 | Neece | 428/100 |
| 4,540,378 | 9/1985 | Cusimano | 428/16 X |
| 4,632,471 | 12/1986 | Visnapuu | 248/442.2 X |
| 4,756,580 | 7/1988 | Middletone, Jr. | 312/7.2 |
| 4,815,683 | 3/1989 | Ferrante | 248/205.2 |
| 4,883,441 | 11/1989 | Byer | 446/901 X |
| 4,950,196 | 8/1990 | Fortune et al. | 428/16 X |
| 4,964,832 | 10/1990 | Bickoff | 446/901 X |
| 4,979,924 | 12/1990 | Manger | 446/901 X |
| 5,006,089 | 4/1991 | Lee | 446/901 X |

FOREIGN PATENT DOCUMENTS

| | | | |
|---|---|---|---|
| 1040358 | 8/1966 | United Kingdom | 428/16 |
| 1289212 | 9/1972 | United Kingdom | 428/100 |
| 1430513 | 3/1976 | United Kingdom | 428/100 |

OTHER PUBLICATIONS

Promotional materials from H+H Enterprises, Las Vegas, Nev., 1987.

*Primary Examiner*—Henry F. Epstein
*Attorney, Agent, or Firm*—G. Donald Weber, Jr.

[57] ABSTRACT

Plush stuffed anatomical members for mounting on a computer monitor or a like object to make the object less intimidating to children and therefore to encourage its use by children. The stuffed anatomical members may include a head member, two arm members, and two feet members. Each member is detachably secured to the object using hook and loop fasteners.

10 Claims, 7 Drawing Sheets

STUFFED ANATOMICAL MEMBERS

FIELD OF THE INVENTION

The present invention relates generally to stuffed animals and more particularly to plush stuffed anatomical members of animals, human and fanciful creatures for mounting on a computer monitor or other inanimate device to make the it less intimidating to children and therefore to encourage its use by children. The stuffed anatomical members are typically comprised of a head member, two arm members, and two feet members. Each member is detachably secured to the computer monitor using hook and loop fasteners.

BACKGROUND OF THE INVENTION

It is well known that children typically have short attention spans and only become seriously motivated to engage in activities that excite their imagination. Therefore, it is generally difficult to motivate a child to spend a significant amount of time pursuing such beneficial activities as working with computers. This is particularly true with younger children, who have extremely short attention spans.

Parents today are increasingly concerned with providing their children with the skills that will benefit them later in life. It is often the parent's desire to motivate their children to acquire these skills at a very young age. These children do not understand that they are developing skills, but rather see only the impersonal apparatus with which they must associate. The impersonal apparatus is sometimes perceived as intimidating to the child, swaying his emotions from the natural desire to learn over to the realm of fear and hostility.

Younger children may also feel uncomfortable when deprived of the direct attention of an adult. It is necessarily true that to become proficient at an activity, the child must be permitted to spend some time practicing without the direct supervision of an adult. Also, it is not practical for an adult to always be present when the child is so occupied. Having the child pursue such activities without the constant direct attention of an adult may exagerate the child's feeling of hostility and discomfort.

It is also well known that many children have behavioral problems and learning disabilities. Many times computer games and educational programs can help overcome these problems. The problem is how to make computers and the like more attractive to such children. These apparatus often appear to a child to be plain and boring, if not somewhat intimidating.

Many adults also perceive computers as complex and intimidating. Making such an adult's computer appear friendlier would certainly tend to increase productivity while reducing stress and fatigue.

Stuffed animals are well known in the prior art for use as playthings by children. Such stuffed animals typically have as contiguous anatomical members a head, a body connected to the head, two arms connected to the body, and two legs with feet also connected to the body. All of the anatomical members taken together therefore comprise a plaything with which children may entertain themselves.

Such stuffed animals typically have a plush outer covering and a soft inner filling. They are designed to be appealing to children and thereby encourage their use as playthings.

Such prior art stuffed animals are always used as playthings themselves. They are not designed to encourage the use of other objects. For example, a small stuffed animal toy is not capable of encouraging constructive behavior and learning activities. It is not capable of encouraging the child to sit at a desk and read a book, or work with a computer, for instance.

As such although the prior art has recognized the appeal of stuffed animals to children, the prior art has not applied this recognition to the problem of making computers and the like less intimidating to children.

SUMMARY OF THE PRESENT INVENTION

The present invention comprises plush stuffed anatomical members for mounting on such apparatus as a video display or the like to make the use of such apparatus less intimidating to children and therefore to encourage its use by children. The stuffed anatomical members may include a head member, two arm members, and two feet members. A tail member is also present in some embodiments. Each member is detachably secured to the desired apparatus using fasteners such as hook and loop fasteners such, such as those known under the trademark VELCRO. The stuffed anatomical members cooperate with the video display to visually define a character, such as a human being, animal, or fanciful creature.

The present invention can be used to encourage children to participate in many constructive activities. Not only can the stuffed anatomical members be attached to a computer's video display, as well as any CRT or T.V., they might also be attached to a child's desk to encourage the child to spend time studying at the desk. In all cases, the stuffed anatomical members transform an otherwise unfriendly and intimidating environment into a friendly environment where the child feels comfortable and secure.

The stuffed anatomical members of the present invention may be fashioned in the form of a cartoon character familiar to the child. The use of such a familiar character would actually encourage the child to participate in the desired activity. Younger children would tend to associate the enjoyable presence of the cartoon character with the constructive activity being performed, thereby forming a positive mental image of the desired constructive activity at an early age.

The present invention therefore provides a means whereby constructive behavior can be encouraged in children. By attaching the stuffed anatomical members of the present invention to the desired apparatus, it is made less intimidating and friendlier to the child. The present invention thereby encourages the child to sit down before a computer or the like and actually begin to learn without feeling lonely or intimidated.

The stuffed anatomical members of the present invention achieve the effect of making the environment in which they are used less lonely and intimidating by personifying the apparatus to which they are attached. This personification is accomplished through the use of anatomical characters, including human and fanciful characters, which impart particular feelings and emotions to the child. For example, a teddy bear is cute and cuddly and therefore imparts a feeling of warmth and well being. A dragon provides a sense of mystery and adventure. A human character may remind the child of a relative or teacher and the love and security associated with that person.

When used with a computer's video monitor, the anatomical members may form a character that is meaningful to the program being executed by the computer. For example, a dragon character could be used when playing the game Dungeons and Dragons.

The positive association between the inanimate device and the stuffed anatomical members of the present invention occurs because the two become a single integral unit in the child's mind. The inanimate device, a computer's video monitor for example, becomes the body of the character formed therefrom. It is, in a young child's mind, an intrinsic part of the character and therefore takes on the positive characteristics of the character.

These, as well as other features and advantages will become more apparent from the following description and drawings.

DETAILED DESCRIPTION OF THE PREFERRED EMBODIMENTS

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
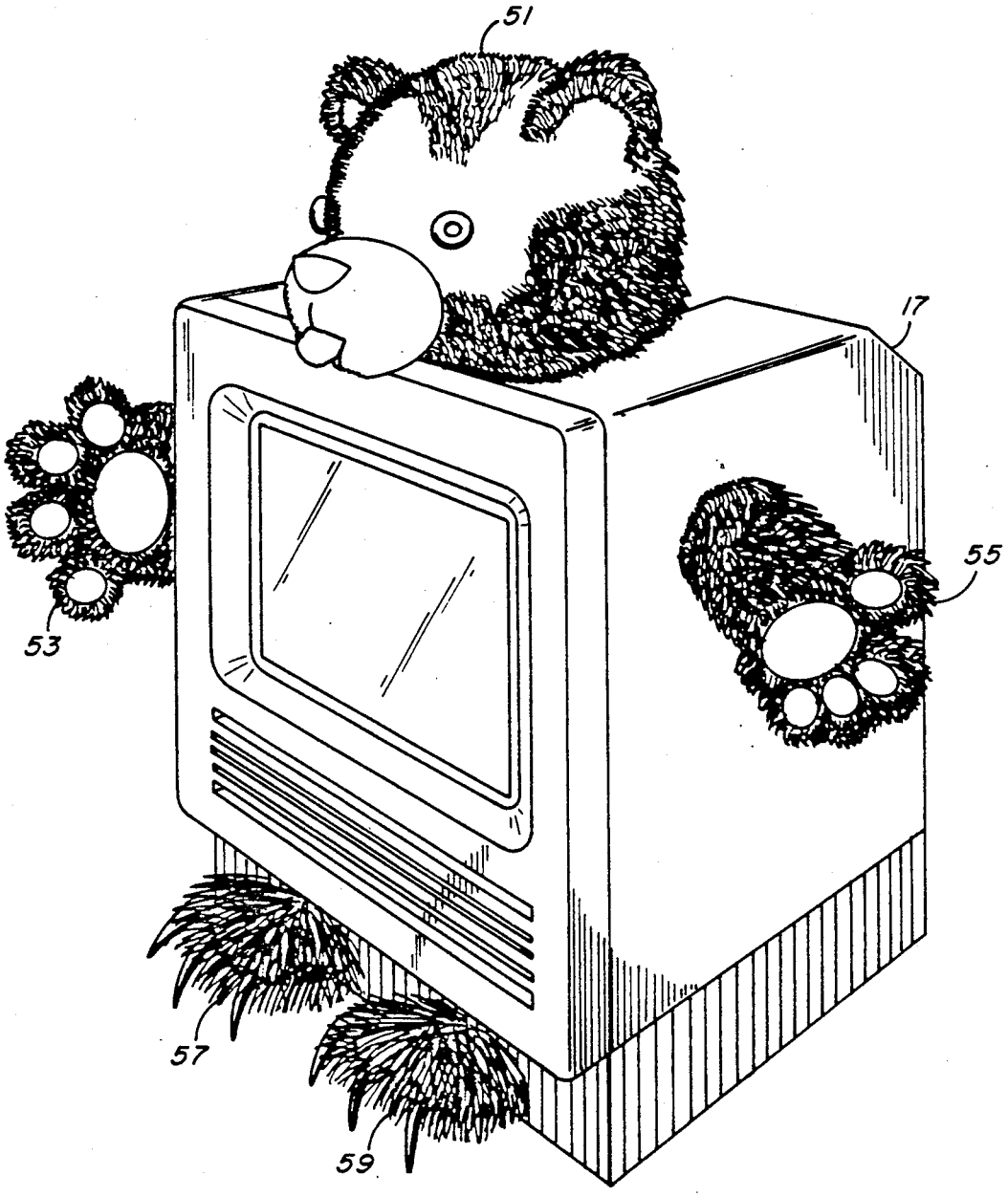
FIG. 1 is a perspective view of a first embodiment of the present invention.
Figure 2:
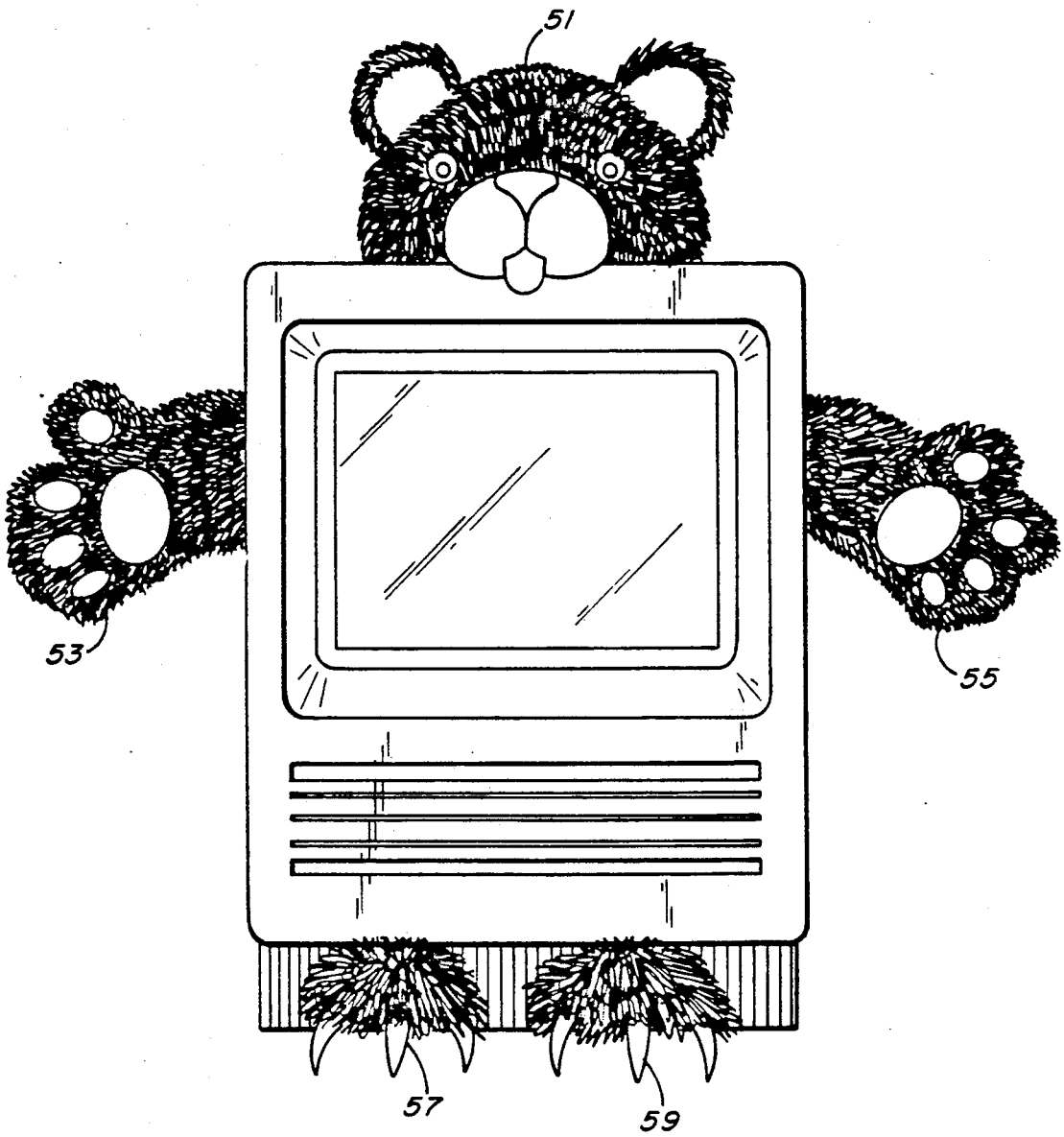
FIG. 2 is a front elevation view of the first embodiment of the present invention.

The stuffed anatomical members of the present invention are illustrated in FIGS. 1-10 which depict four presently preferred embodiments of the invention. Referring now to FIG. 1, stuffed anatomical members for a bear are depicted attached to a video monitor 17. The bear comprises a head 51, a right arm 53, a left arm 55, a right foot 57, and a left foot 59.

Figure 3:
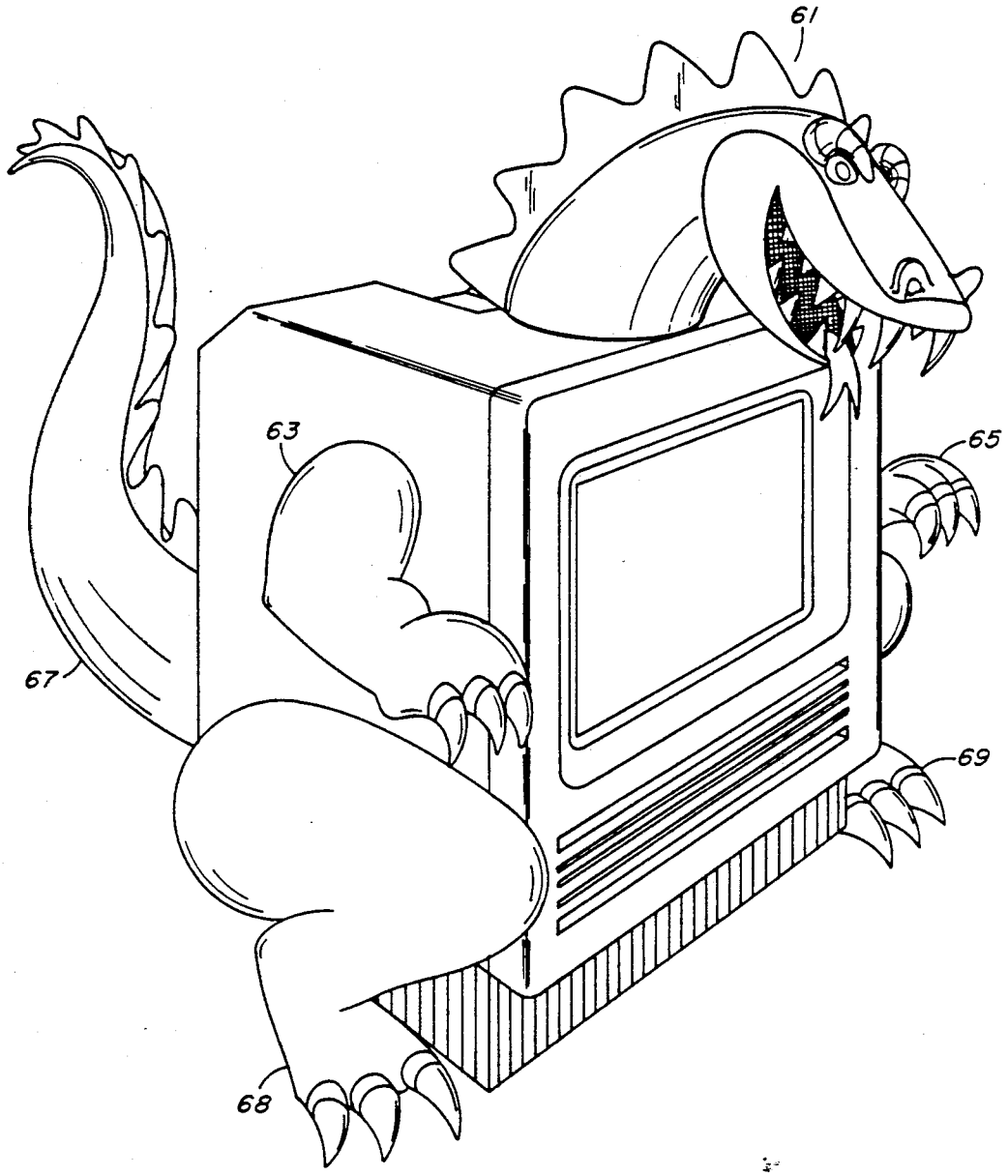
FIG. 3 is a perspective view of a second embodiment of the present invention.
Figure 4:
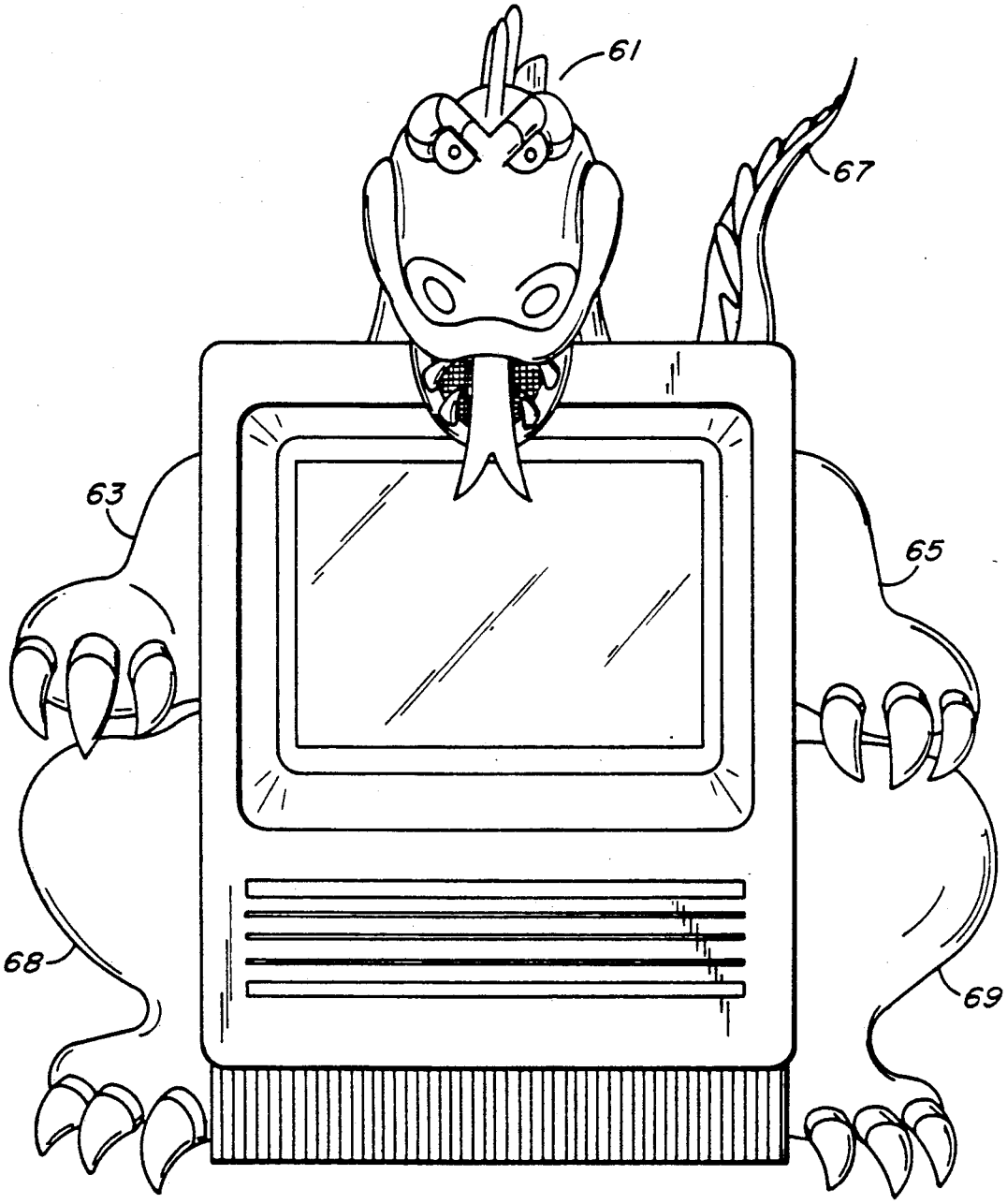
FIG. 4 is a front elevation view of a second embodiment of the present invention.

Referring now to FIGS. 3 and 4, a second embodiment of the present invention is depicted. In the second embodiment a stuffed dragon comprises a head 61, a right arm 63, a left arm 65, a right foot 68, a left foot 69, and a tail 67.

Figure 5:
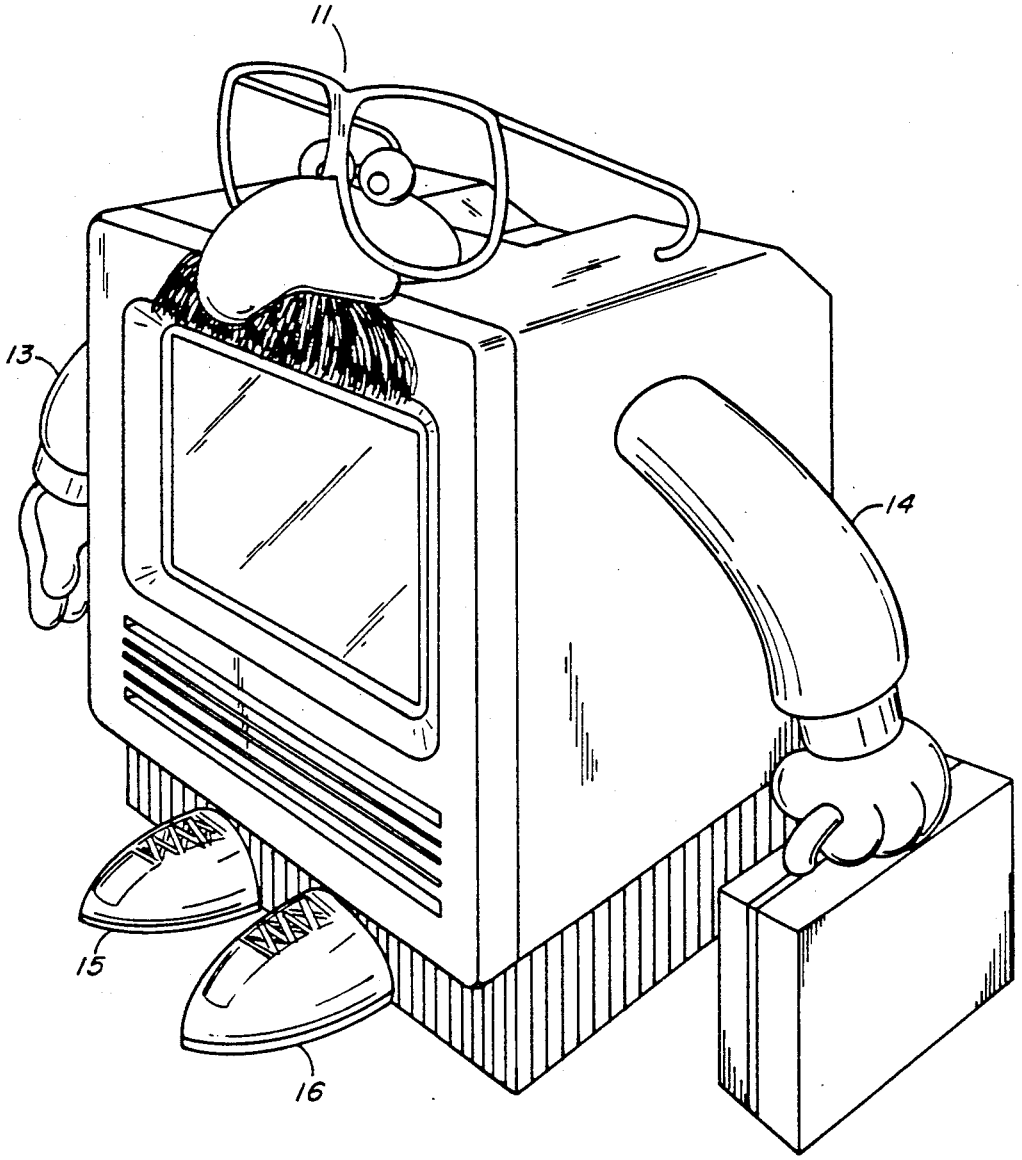
FIG. 5 is a perspective view of a third embodiment of the present invention.

Referring now to FIG. 5, a third embodiment of the present invention is depicted. Stuffed anatomical members for a man comprise a head member 11, a right arm 13, a left arm 14, a right foot 15, and a left foot 16.

Figure 6:
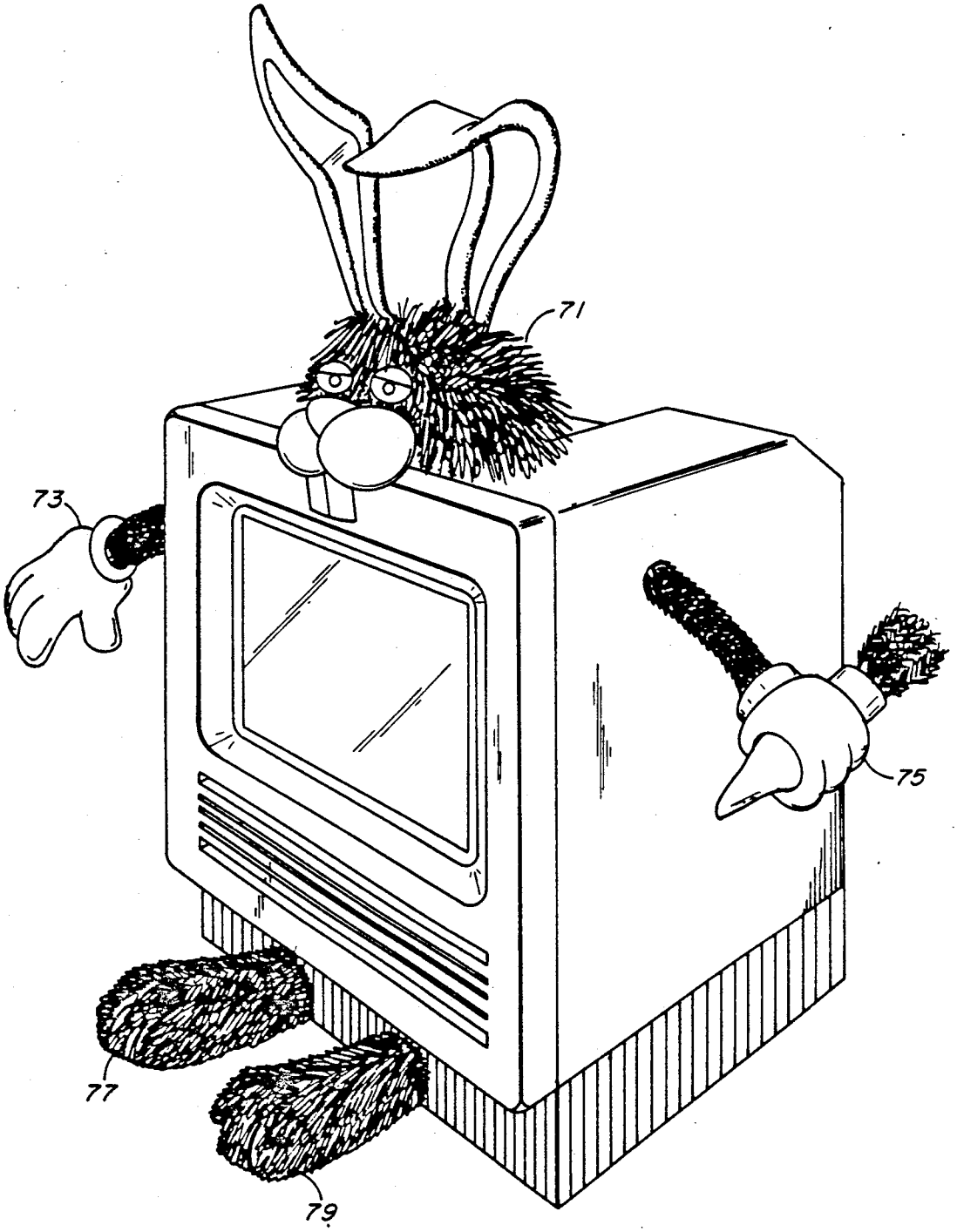
FIG. 6 is a perspective view of a fourth embodiment of the present invention.

Referring now to FIG. 6, a fourth embodiment of the present invention is depicted. Stuffed anatomical members for a rabbit comprise a head 71, a right arm 73, a left arm 75, a right foot 77, and a left foot 79.

Figure 7:
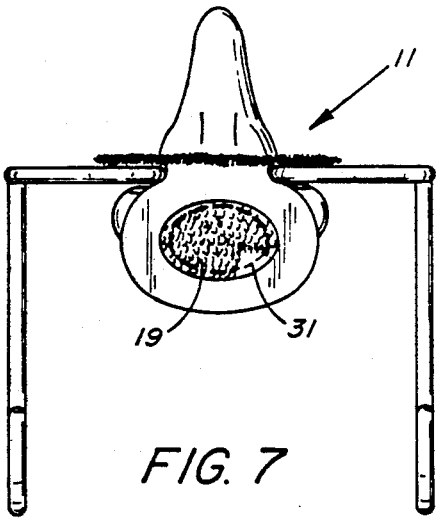
FIG. 7 is a bottom plan view of the head member of the third embodiment of the present invention depicted in FIG. 5.
Figure 8:
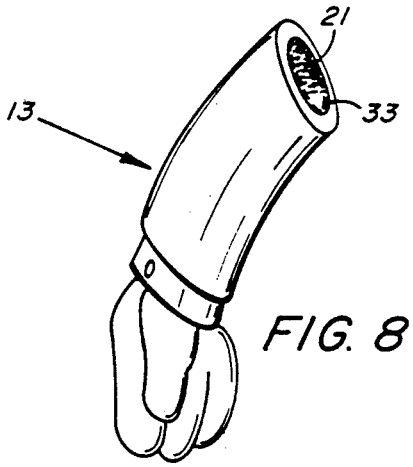
FIG. 8 is a perspective view of one arm member of the third embodiment of the present invention depicted in FIG. 5.
Figure 9:
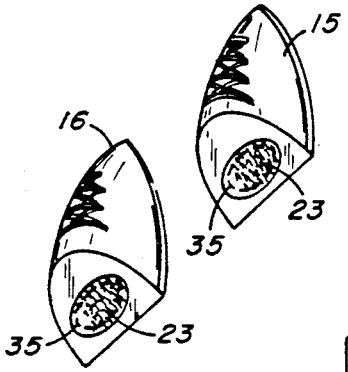
FIG. 9 is a perspective view of the feet members of the third embodiment of the present invention depicted in FIG. 5.
Figure 10:
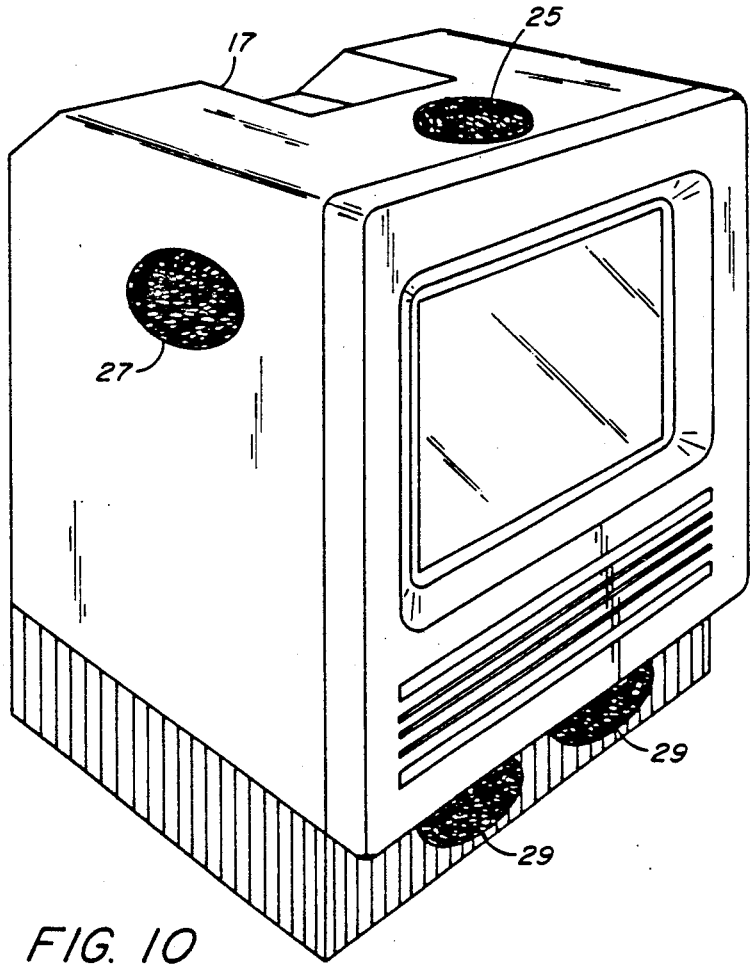
FIG. 10 is a perspective view of the video monitor showing placement of the hook and loop fastener mating surfaces.

The stuffed anatomical members of each of the four embodiments of the present invention are attached to a video monitor using hook and loop fasteners. As depicted in FIG. 7 a first mating surface of a hook and loop fastener 19 is secured with stitches 31 to a head member 1. A corresponding second, velcro mating surface 25 is secured to the video monitor with a suitable adhesive, as shown in FIG. 10. FIG. 8 depicts a first mating surface of a hook and loop fastener 21 attached to an arm member 13 by means of stitches 33. FIG. 9 depicts two foot members 15 and 16, each foot member 15 and 16 having a first hook, and loop fastener mating surface 23 attached thereto by means of stitches 35.

As shown in FIG. 10, second hook and loop fastener mating surfaces 25, 27, and 29 are attached to a video monitor with a suitable adhesive.

Each stuffed anatomical member of the present invention generally comprises a plush outer covering formed in the shape of an anatomical member and stuffed with a soft, resilient material such as cotton, polystyrene beads, or flexible polyurethane or similar suitable material.

Hook and loop fastener mating surfaces are common where a protective covering can be peeled from each of said mating surfaces, thereby exposing a layer of adhesive. This permits the user to simply peel off the protective layer and attach the hook and loop fastener mating surface to any desired surface. This is the manner of attachment contemplated for the second hoop and loop fastener mating surfaces of the present invention.

The stuffed anatomical members of the present invention are used simply by attaching them to an inanimate device. Attachment is made by first attaching the second hook and loop fastener mating surfaces to the inanimate device in the locations where the anatomical members are to be attached. Next the anatomical members are attached to the inanimate device so as to personify the inanimate device. The inanimate device forms the body of the character formed by attachment of the anatomical members.

While in the preferred embodiments hook and loop fasteners are preferably used to attach the stuffed anatomical members to inanimate objects, a suitable adhesive can alternatively be used.

It is understood that the exemplary stuffed anatomical members described herein and shown in the drawings represent only presently preferred embodiments of the invention. Indeed various modifications and additions may be made to such embodiments without departing from the spirit and scope of the invention. For example, the size, shape, and construction of the various anatomical members can be different from those shown. Many different anatomical characters are possible. Thus, these and other modifications and additions may be obvious to those skilled in the art and may be implemented to adapt the present invention for use in a variety of different applications.

What is claimed is:

1. A combination using stuffed anatomically shaped members for the ornamental personification or characterization of a video monitor comprising:

a multi-surfaced video monitor;

a plurality of three-dimensional stuffed anatomically shaped members selectively attachable to said video monitor wherein all of said stuffed anatomically shaped members cooperate with said video monitor to visually define a character;

a first hook and loop fastener mating surface attached to each of said stuffed anatomically shaped members;

a plurality of second hook and loop fastener mating surfaces attachable to one or more surfaces of said video monitor;

each of said second hook and loop fastener mating surfaces being a corresponding mating surface to each of said first hook and loop fastener mating surfaces to thereby facilitate detachable attachment of said anatomically shaped members to said video monitor;

each of said stuffed anatomically shaped members serves as an appendage of a character and said video monitor serves as the body of the character; and each of said anatomically shaped members is formed of a resilient material.

2. The combination recited in claim 1 wherein:

said first hook and loop fastener mating surface is attached to said stuffed anatomically shaped member by sewing; and said second hook and loop fastener mating surface is attachable to the video monitor by bonding with an adhesive.

3. The members as recited in claim 1 wherein, each said anatomical member is formed of a resilient material.

4. The members as recited in claim 3 wherein, said resilient material is flexible polyurethane.

5. The members as recited in claim 1 wherein, said anatomical members have a plush outer covering.

6. In combination, a video monitor, a plurality of stuffed anatomical members for the personification of said video monitor comprising:

a head-shaped member selectively attachable to and detachable from the top of said video monitor;

two arm-shaped members selectively attachable to and detachable from opposite sides of said video monitor wherein said video monitor cooperates with said plurality of stuffed anatomical members to visually define a character; and a plurality of hook and loop fasteners with first and second mating surfaces;

a separate first mating surface attached to said head-shaped member and to each of said arm-shaped members;

said plurality of second mating surfaces attachable to the top and sides of said video monitor, each of said second mating surfaces being a corresponding mating surface to one first mating surface, respectively, thereby facilitating detachable attachment of said head-shaped member and said arm-shaped members to said video monitor.

7. The combination recited in claim 6 wherein:

(a) said first mating surface is attached to the head-shaped member and to each of the arm-shaped members by sewing; and (b) said second mating surface is attachable to said video monitor by an adhesive.

8. The combination recited in claim 6 further comprising, two foot-shaped members selectively attachable to and detachable from said video monitor.

9. The combination recited in claim 8 further comprising:

a plurality of hook and loop fasteners with first and second mating surfaces;

one first mating surface attached to each of said foot-shaped members; and two second mating surfaces attachable to the video display, each of said second fastener mating surfaces being a corresponding mating surface to a first mating surface, thereby facilitating detachable attachment of said foot-shaped members to said video monitor.

10. The combination recited in claim 9 wherein:

(a) the first hook and loop fastener mating surface is attached to each foot-shaped member by sewing; and (b) the second hook and loop fastener mating surface is attachable to the video monitor by an adhesive.

* * * * *